US009316426B2

(12) United States Patent
Almblad

(10) Patent No.: US 9,316,426 B2
(45) Date of Patent: Apr. 19, 2016

(54) ARTICULATED CURTAINS FOR ICE MAKING MACHINES

(75) Inventor: Jay Martin Almblad, Westminster, CO (US)

(73) Assignee: Scotsman Group LLC, Vernon Hills, IL (US)

( * ) Notice: Subject to any disclaimer, the term of this patent is extended or adjusted under 35 U.S.C. 154(b) by 626 days.

(21) Appl. No.: 13/315,953

(22) Filed: Dec. 9, 2011

(65) Prior Publication Data

US 2012/0174601 A1 Jul. 12, 2012

Related U.S. Application Data

(60) Provisional application No. 61/422,087, filed on Dec. 10, 2010.

(51) Int. Cl.
*F25C 1/00* (2006.01)
*F25C 1/12* (2006.01)

(52) U.S. Cl.
CPC ..... *F25C 1/12* (2013.01); *F25C 2400/04* (2013.01)

(58) Field of Classification Search
CPC ..... F25C 1/00; F25C 1/12
USPC ..... 62/347–348, 345, 74
See application file for complete search history.

(56) References Cited

U.S. PATENT DOCUMENTS

| | | | | |
|---|---|---|---|---|
| 3,220,205 | A * | 11/1965 | Breeding | 62/73 |
| 3,423,952 | A * | 1/1969 | Pugh | 62/138 |
| 3,430,452 | A * | 3/1969 | Dedricks et al. | 62/138 |
| 4,365,485 | A * | 12/1982 | Samuelsen | 62/320 |
| 4,489,567 | A | 12/1984 | Kohl | |
| 4,727,729 | A | 3/1988 | Toya | |
| 4,938,030 | A | 7/1990 | Josten et al. | |
| 4,986,088 | A | 1/1991 | Nelson | |
| 5,924,301 | A | 7/1999 | Cook | |
| 7,832,219 | B2 | 11/2010 | Baranowski et al. | |
| 2002/0020177 | A1 | 2/2002 | Billman et al. | |
| 2008/0156019 | A1 * | 7/2008 | Baranowski et al. | 62/340 |

FOREIGN PATENT DOCUMENTS

| | | | |
|---|---|---|---|
| CN | 1475717 | A | 2/2004 |
| CN | 1570525 | A | 1/2005 |
| EP | 1347256 | A2 | 9/2003 |
| JP | 2003343948 | A | 12/2003 |

OTHER PUBLICATIONS

Nikravesh, Parviz E ., Planar Multibody Dynamics: Formulation, Programming and Applications, 2007, CRC Press, p. 65.*
European Search Report dated Jul. 24, 2012 (4 pages) for European Application No. 11192726.5.
Chinese Office Action dated Mar. 10, 2015, for Chinese Patent Application No. 201110462554.X.

* cited by examiner

*Primary Examiner* — Marc Norman
*Assistant Examiner* — David Teitelbaum
(74) *Attorney, Agent, or Firm* — Schiff Hardin LLP

(57) ABSTRACT

Articulated water curtains for ice making machines include two portions, an upper portion hingedly connected to the upper portion of the machine, and a lower portion that includes a bottom edge of the two-piece water curtain and that is pivotally-mounted to a lower portion of the machine or to the lower portion of the water curtain.

7 Claims, 12 Drawing Sheets

ARTICULATED CURTAINS FOR ICE MAKING MACHINES

CROSS-REFERENCE TO RELATED APPLICATIONS

The present application claims priority to U.S. Provisional Application No. 61/422,087, filed on Dec. 10, 2010.

BACKGROUND OF THE DISCLOSURE

1. Field of the Disclosure

This disclosure generally relates to the field of ice-making machines. More particularly, the present disclosure relates to ice-making machines that use articulated water curtains in the ice-making process.

2. Discussion of the Related Art

Some currently available ice-making machines have a substantially vertical ice-forming mold or evaporator for freezing waffles, slabs, sheets or cubes of ice (hereinafter "ice-forms"). A water distributor sends water over a front surface or grating of the mold or evaporator, and pumps circulate water continually through the distributor. A refrigeration circuit operates during the ice-making step so that ice is formed on the plate or grating of the evaporator. A hinged water curtain can have a bottom edge for directing the cascading water into a sump.

FIG. 1 discloses a conventional ice-making machine 10 comprising a one-piece water curtain 12 that is hung on a pair of horizontally disposed pivot pins or pivot points 14 (one shown) adjacent the top of a water distributor 16. Water curtain 12 has externally protruding strengthening ribs 18 and has a bottom edge portion 20 that hangs free over a water sump 22. FIG. 1 shows ice machine 10 in a closed position during an ice freezing or manufacturing cycle.

FIG. 2 shows ice-making machine 10 of FIG. 1 during a harvest cycle, when ice-forms drop out or off of evaporator 24, and hit and push the inside surface of curtain 12 away from evaporator 24. This allows the ice to fall along the inside surface of curtain 12, hit the bottom edge portion 20 of curtain 12 and pass into ice chute 26.

One problem with these conventional machines is that they employ a single-piece water curtain 12 that hangs from a single pair of aligned pivot points 14 or pivot pins mounted along a horizontal axis near or adjacent the top of an evaporator. Given this design, the weight of the conventional single-piece curtain is excessive and requires excessive energy for the machine or operator to open the curtain.

In addition, during a harvest cycle in conventional machines, the harvested ice-form is undesirably more likely to break if and when it hits a single-piece curtain, due to that single-piece's greater mass. The bottom edge 20 of the conventional single-piece curtain 12 of FIGS. 1 and 2 is not pivotable.

Another problem with conventional ice-making machines is that they do not sense and help resolve the complications arising from a controller in the machine being unable to distinguish between a condition where the bin for collecting the ice-forms is actually full, and a false full bin condition.

The present disclosure addresses these disadvantages.

SUMMARY OF THE DISCLOSURE

The present disclosure provides an articulated two piece or portion water curtain, and an ice-making machine using the same. The water curtain of the present disclosure comprises two pieces or portions. An upper piece or portion is hingedly connected to an ice-making machine at or near a top of the water curtain, and a separate, lower piece or portion includes a bottom edge. The lower piece or portion is hingedly- or pivotably-mounted to pivot points or pivot pins adjacent to a lower edge of the upper piece or portion. The term "water curtain" is used for convenience, and in the context of the present disclosure, the water curtain works in conjunction with both water and ice, as is discussed in greater detail below.

In one embodiment the present disclosure provides an ice-making machine, comprising an evaporator aligned in a generally vertical orientation, the evaporator comprising an ice-forming surface, a distributor at a top end of the evaporator, the distributor for distributing water over the ice-forming surface, and a water curtain aligned in a generally vertical orientation. The water curtain is located adjacent to and parallel to the evaporator, and comprises a first portion and a second portion pivotally connected to the first portion, each of the first portion and the second portion having a top end and a bottom end. The top end of the first portion is pivotally connected to a top end of the ice-making machine, and the top end of the second portion is pivotally connected to the bottom end of the first portion.

In another embodiment, the present disclosure provides a method of making ice. The method comprises the steps of distributing water over an ice-forming surface of an evaporator, cooling the ice-forming surface to form the ice during a freeze cycle, detecting a thickness of the ice formed on the ice-forming surface, initiating a harvest cycle to harvest the ice when the thickness reaches a first value, and diverting the water to a sump with an articulated water curtain during the freeze cycle, and diverting the ice to a bin during a harvest cycle. The articulated water curtain comprises a first portion and a second portion pivotably connected to the first portion.

BRIEF DESCRIPTION OF THE DRAWINGS

FIG. 9A' is a perspective the upper piece or portion of FIG. 9;

DETAILED DESCRIPTION OF THE PREFERRED EMBODIMENTS

Figure 2:
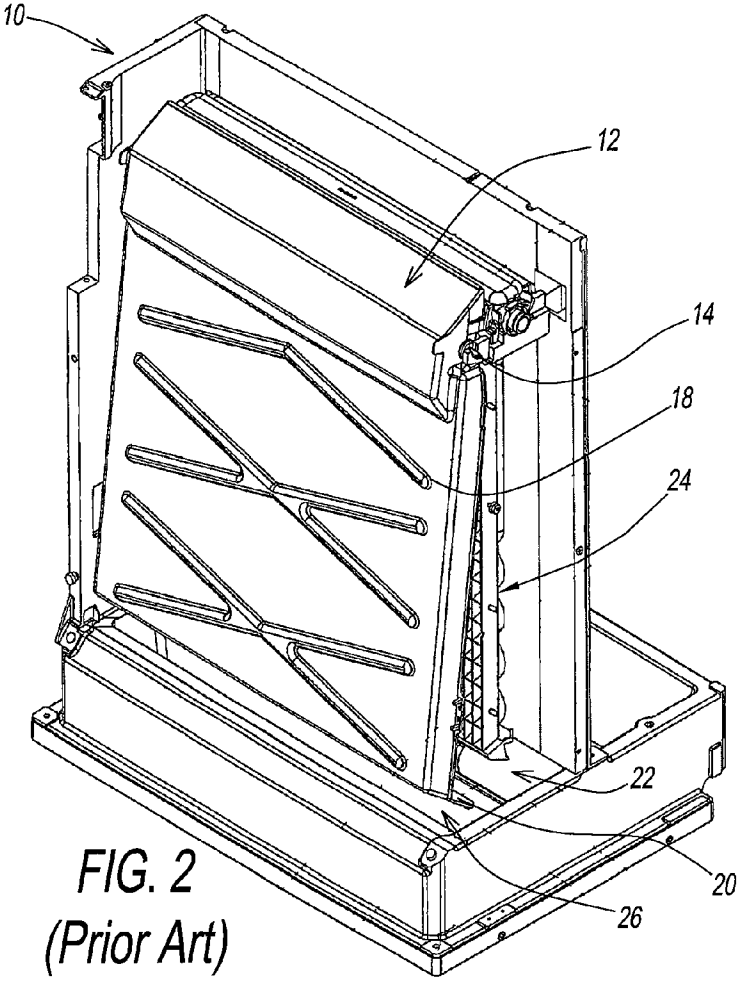
FIG. 2 (Prior Art)
FIG. 2 is an elevated front perspective view of the prior art ice making machine of FIG. 1, showing the single-piece curtain open during an ice harvest cycle.
Figure 1:
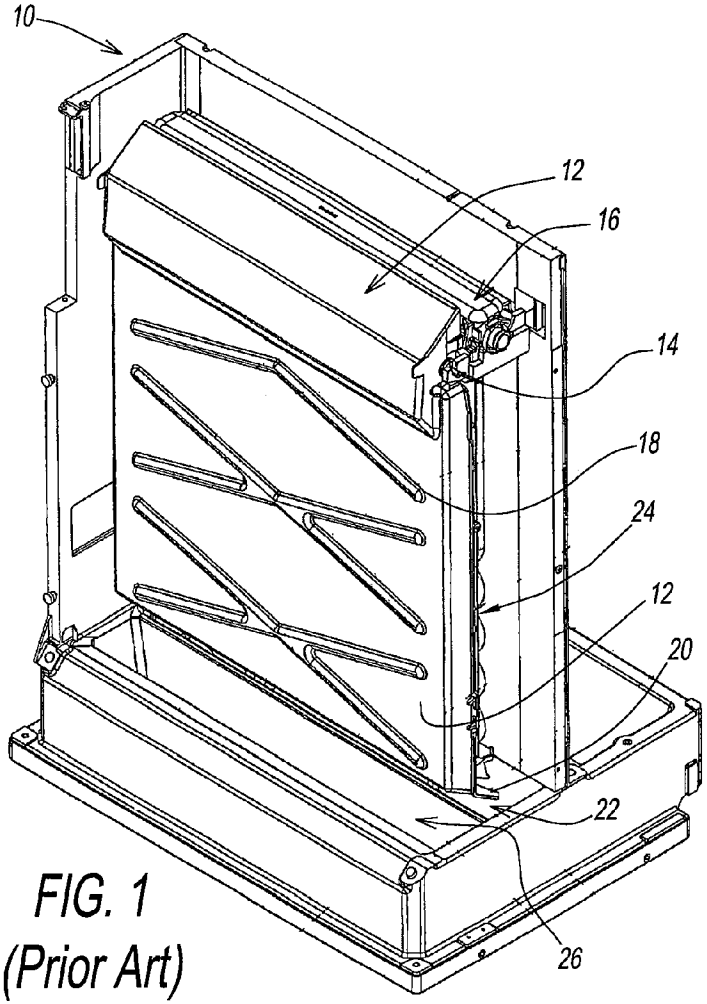
FIG. 1 (Prior Art)
FIG. 1 is an elevated front perspective view of a prior art ice-making machine, showing the single-piece curtain closed during a freeze cycle.
Figure 4:
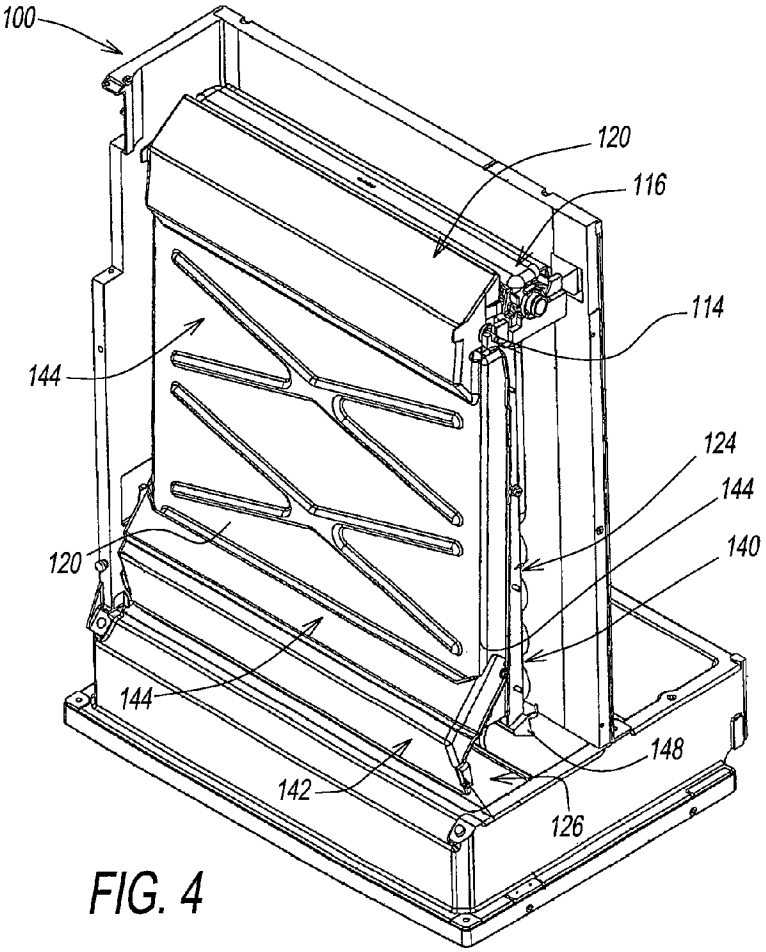
FIG. 4 is an elevated front perspective view of the ice-making machine of FIG. 3, during a harvest cycle.
Figure 3:
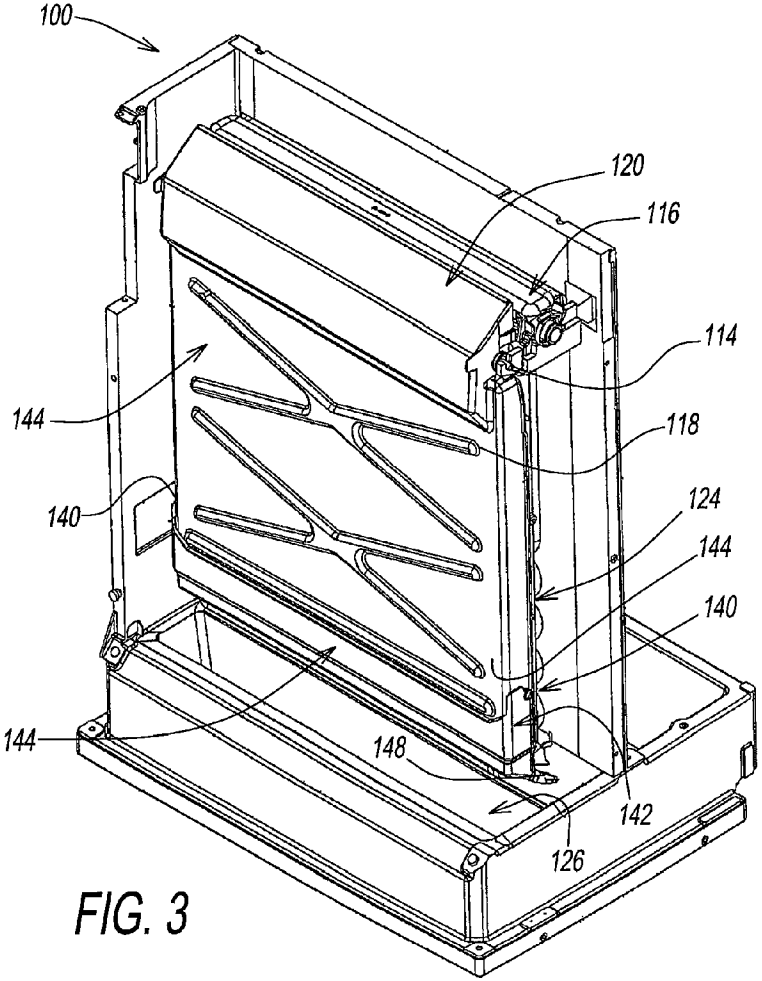
FIG. 3 is an elevated front perspective view of an ice-making machine of the present disclosure, during a freeze cycle.

Referring to the Figures, and in particular FIGS. 3 and 4, ice-making machine 100 of the present disclosure is shown. Ice-making machine 100 comprises an improved articulated or articulatable water curtain 144, which in turn comprises a top or upper piece or portion 120, and a bottom or lower (sometimes referred to as the or a "second") piece or portion 142. FIG. 3 shows the articulated ice or water curtain 144 in a closed position during a freeze cycle. FIG. 4 shows the articulated ice or water curtain 144 in an open position during an ice harvest cycle when ice drops through machine 100.

FIGS. 3 and 4 each show a pair of horizontally aligned pivot points 114 and/or 140 at and by which articulated curtain bottom portion 142 is hingedly or pivotally attached to curtain top portion 120, to form improved two-piece articulated water curtain 144. In FIG. 3, articulated bottom portion 142 is parallel with top portion 120, to be closed for ice freezing. In FIG. 4, articulated bottom portion 142 is pivoted away from evaporator 124) to be open for ice harvesting. Thus, in the two-piece curtain design of the disclosure, the lower portion of the curtain is also pivot-hinged at pivot points 140 to the ice making machine from a lower portion of, preferably near the bottom portion of, the machine. The second, lower portion of the dual or two-piece curtain is hung, that is, pivotally mounted to the upper portion or first piece. The second, lower portion of the curtain, with the upper portion, is of less mass than the standard single-piece curtain design. The dual-piece curtain requires less energy from the ice slab to open or pivot the lower portion of the dual piece curtain. Water curtain 144 can be made of an acrylonitrile butadiene styrene plastic, polymer or copolymer material, or the like.

The articulated, two-piece water curtain of the present disclosure thus overcomes the disadvantages of currently available machines. The second piece or portion of the water curtain has less mass than the standard, conventional one-piece curtain. The falling ice-form is accordingly less likely to break when it hits the pivotable, rearwardly movable second curtain piece or portion. The second piece gives and pivots in a downward and rearward arc, on contact, out of the way of the falling ice slab. The water curtain of the present disclosure also helps to reduce or eliminate false full bin readings, and significantly reduces ice jams during the harvest cycle.

Figures 5, 6, 7, 8:
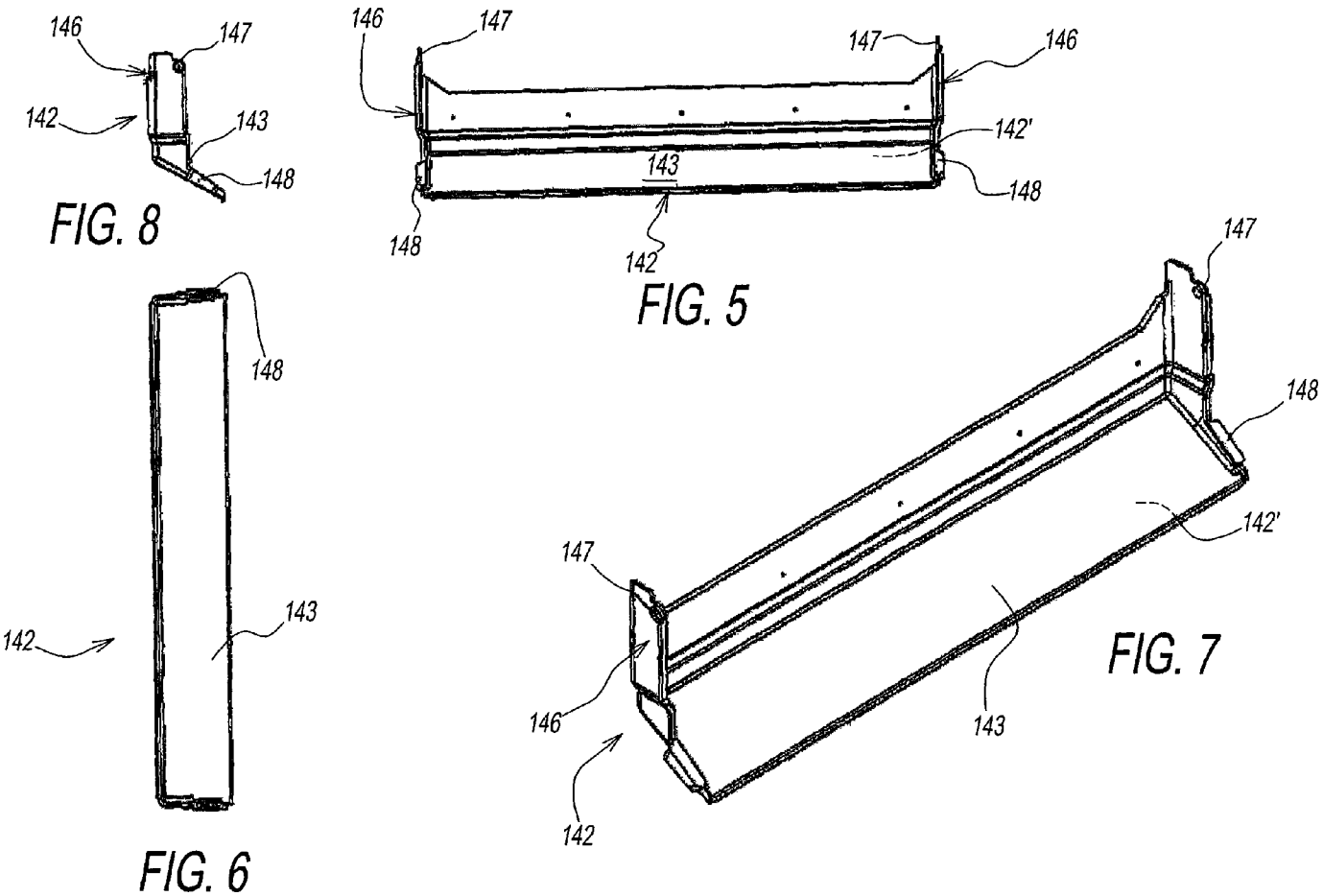
FIG. 5 is a front view of the lower piece or portion of the water curtain of the present disclosure.
FIG. 6 is a top view of the lower piece or portion of FIG. 5.
FIG. 7 is a perspective view of the lower piece or portion of FIG. 5.
FIG. 8 is a side view of the lower piece or portion of FIG. 5.

FIGS. 5-8 show bottom second piece or portion 142 having a pair of opposed mounting arms 146, each arm having a pivot pin hole 147 for hingedly or pivotally mounting arm 146 on a lower pivot pin 1490 (see FIGS. 9, 9A, 9B) disposed on a lower or bottom portion of portion 120. FIG. 5 shows a pair of magnet switch boxes 148, one of the pair for each arm 146, and a top surface 143 and a bottom surface 142') of bottom second piece 142.

Figure 9A:
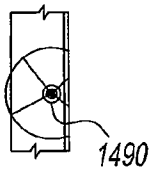
FIG. 9A shows a side view of detail D of FIG. 9.
Figure 9A:
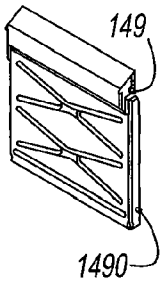
Figure 9:
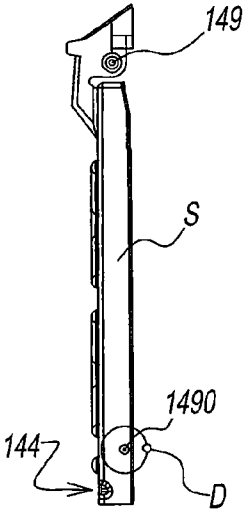
FIG. 9 is a side view of the upper piece or portion of the water curtain of the present disclosure.
Figure 9B:
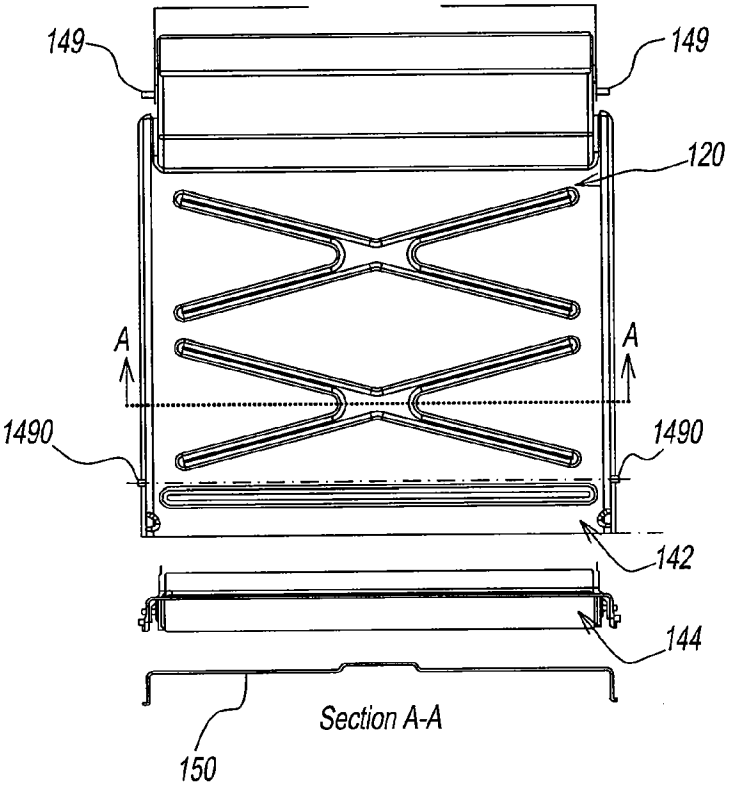
FIG. 9B shows a rear view, a bottom view, and a sectional view along line A-A of the upper piece or portion of FIG. 9.

FIGS. 9-9B show views of upper portion 120. Upper portion 120 has surround side S that wraps around evaporator 124 in machine 100, and an upper pivot pin 149, and lower pivot pin 1490. FIG. 9A shows a side view of detail D. In one embodiment, lower pivot pin 1490 is one-piece molded to surround S for pivotally or hingedly placing or molding articulated lower curtain portion 142 thereon. FIG. 9A shows an isometric view of upper portion 120.

Figure 10B:
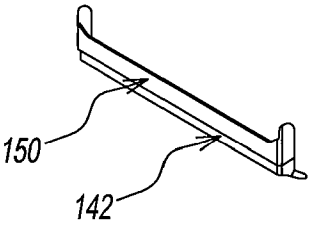
FIG. 10B is a rear, perspective view of the lower piece or portion of FIG. 5.
Figure 10A:
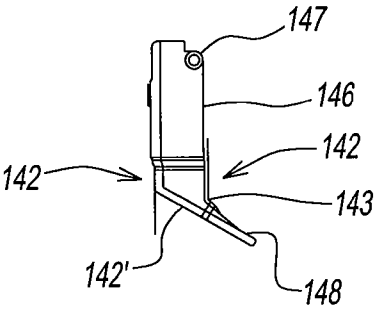
FIG. 10A shows a second side view of the lower piece or portion of FIG. 5.
Figure 10:
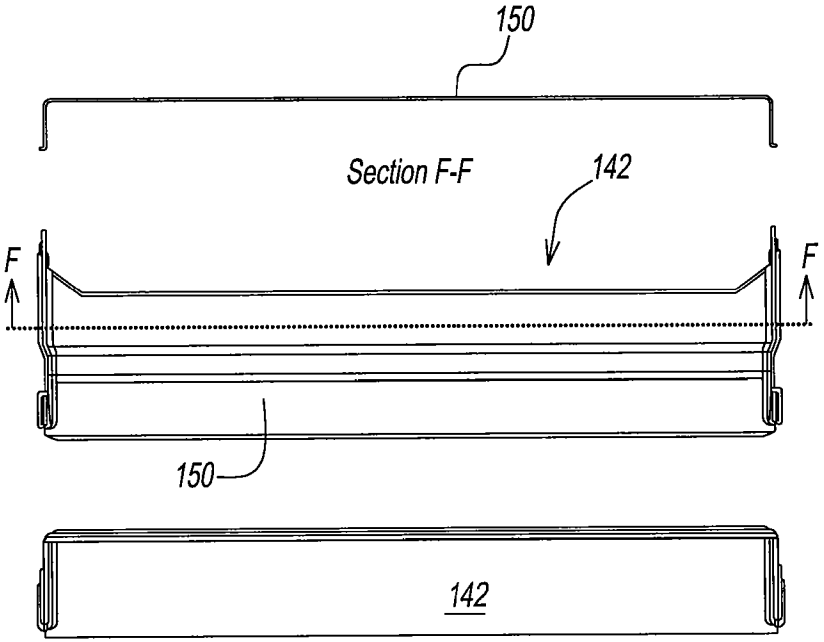
FIG. 10 shows a rear, bottom, and sectional view along line F-F of the lower piece or portion of FIG. 5.
Figure 10C:
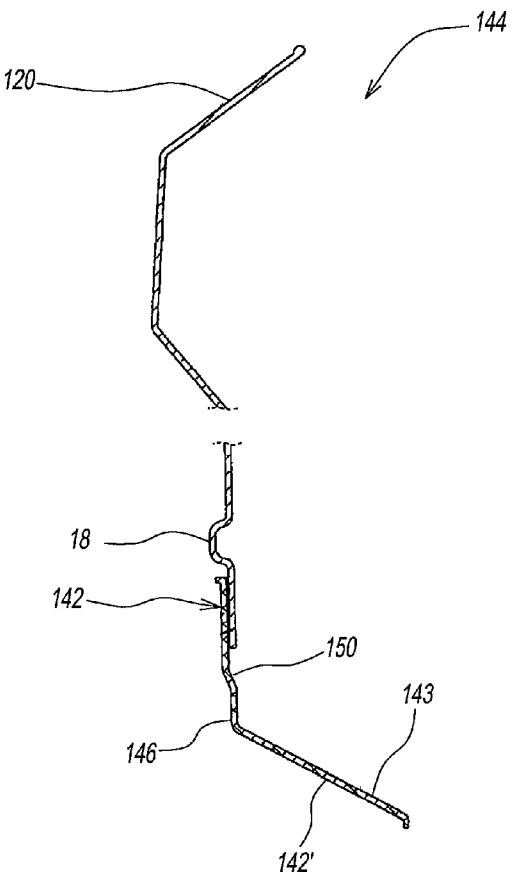
FIG. 10C is a cross-sectional view of the water curtain of the present disclosure.

FIGS. 10-10B show bottom portion 142 in greater detail. Mounting arm 146 pivotally mounts bottom portion 142 to upper portion 120. Mounting arm 146 has a pivot pin hole 147 for mounting or molding pivot pin 1490. FIG. 10B shows rear wall 150 for providing an overlap between the two-pieces, that is, between the bottom edge of top portion 120 and the top edge of bottom portion 142. FIG. 10C is a vertical sectional view, with a portion broken away, showing a preferred profile of rear cover wall 150.

Figure 11:
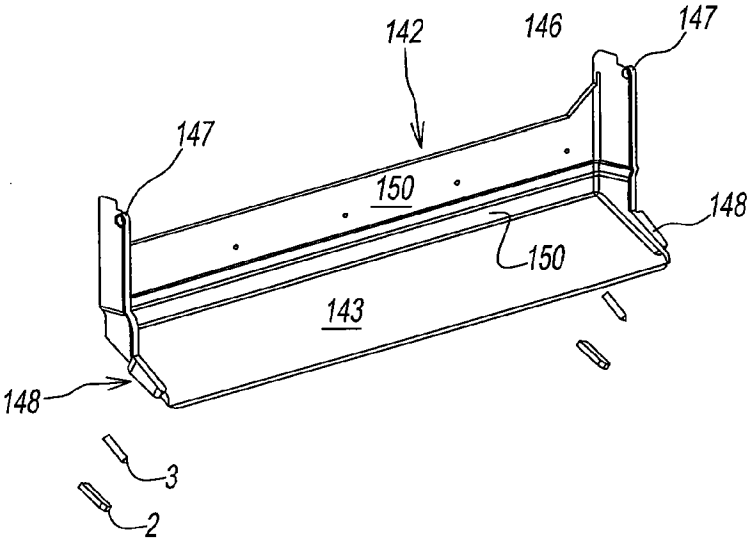
FIG. 11 is a second perspective view of the lower piece or portion of FIG. 5.

FIG. 11 is another view of bottom portion 142, with upper surface 143, a bottom surface 142', a rear wall 150, and a magnet assembly comprised of two pockets 148, one attached to each side edge of bottom portion 142. A magnet 3 is placed in each pocket 148 and a cover 2 is sonically welded and hermetically sealed onto each pocket 148.

FIG. 11 shows an advantageous features of the present disclosure, namely, that bottom curtain assembly 142, with its pivot pin holes 147, is a single molded integral part or piece that hangs on pivot pin 1490, which in turn is a single molded integral part of sidewall S of evaporator 24. When mounted together, these single molded integral parts comprise and provide an integral articulated water or ice curtain 144.

Figure 12:
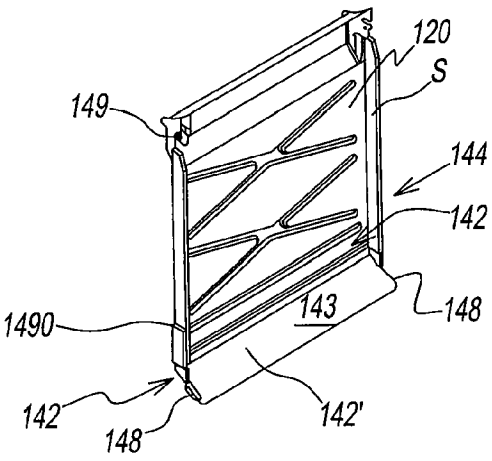
FIG. 12 is a front perspective view of the water curtain of the present disclosure.

FIG. 12 is a front perspective view of the two-piece water curtain 144 of the present disclosure. FIG. 12 shows the improved two-piece or dual water curtain 144 comprised of articulated curtain-top piece or portion 120 and articulated curtain-bottom piece or portion 142.

Figure 13:
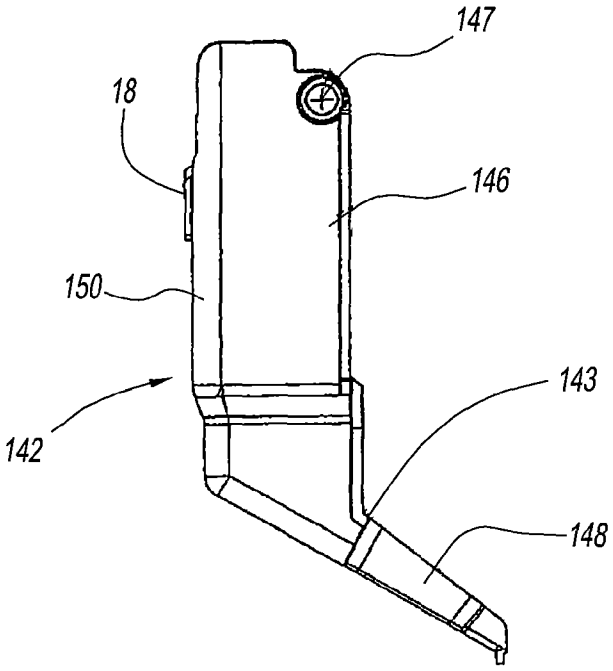
FIG. 13 is an enlargement of FIG. 8.

FIG. 13, an enlargement of FIG. 8, shows pivotable mounting arm 146 for mounting bottom piece or portion 142 to upper curtain piece or portion 120 to obtain two-piece or dual water curtain 144.

Figure 14:
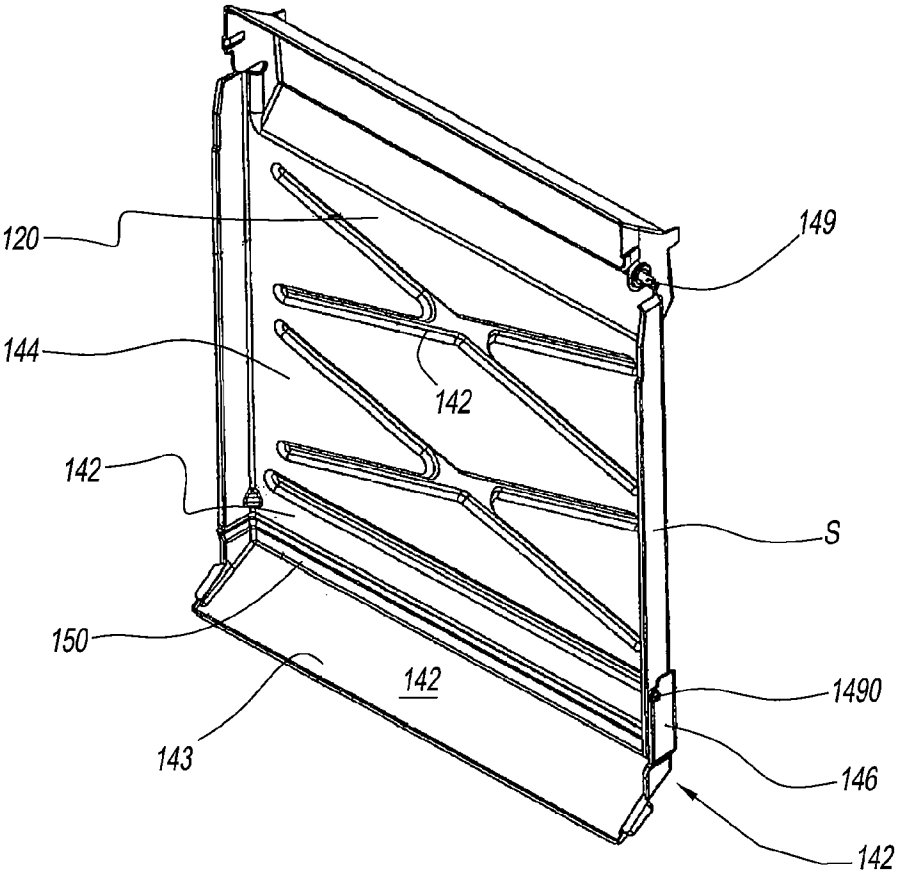
FIG. 14 is a second, front perspective view of the water curtain of the present disclosure.

FIG. 14 is a front perspective view of the dual-piece water curtain 144 of the disclosure. FIG. 14 shows mounting arm 146 pivotally mounted on lower pivot pin 1490 to sidewall S of upper portion 120.

Figure 15:
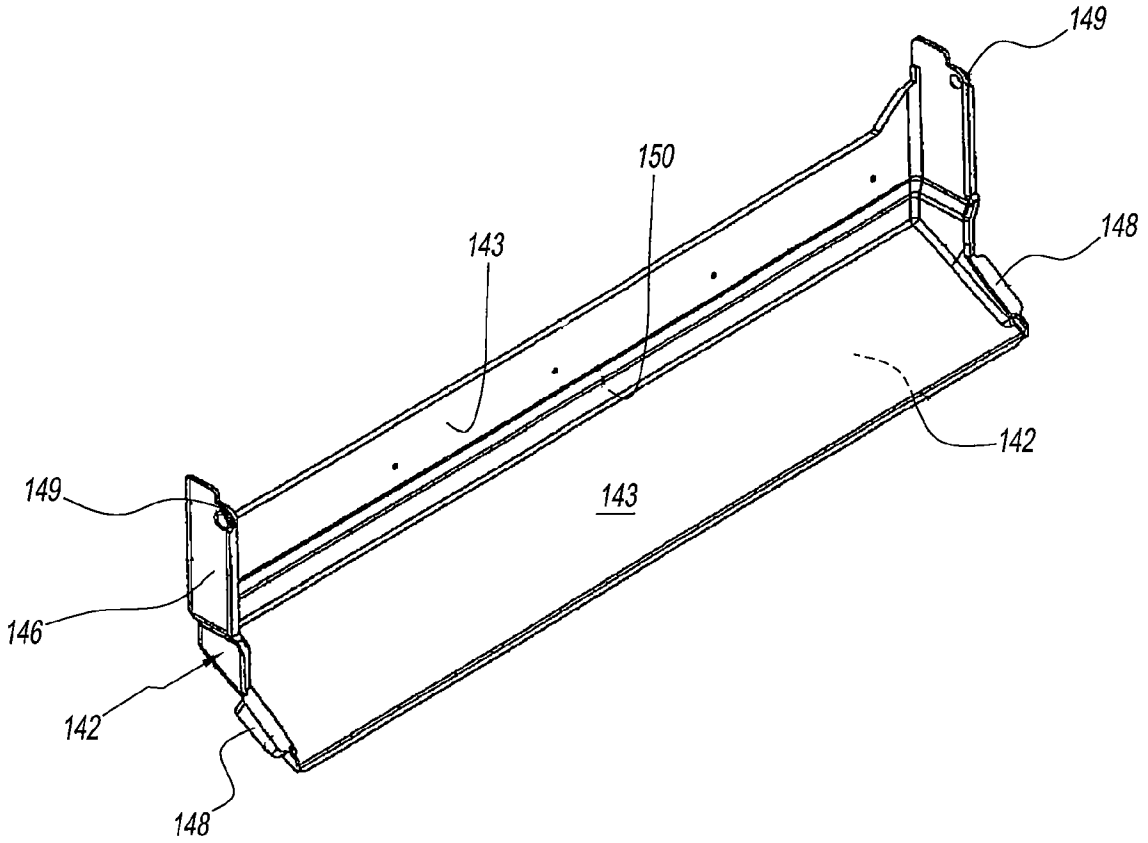
FIG. 15 is a third perspective view of the lower piece or portion of FIG. 5.

FIG. 15 is an elevated rear perspective view of the integral one-piece molded bottom piece 142 of water curtain 144 of the present disclosure. FIG. 15 shows pivot pin holes 149, and also shows upper surface 143 of the articulated bottom piece 142 that is struck or engaged by the bottom portion of a slab of ice during the harvest cycle or mode of the ice making machine.

Figure 17:
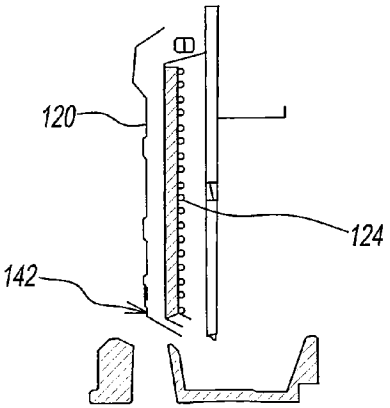
FIG. 17 is a cross-sectional view of the ice making machine of FIG. 16 along line 17-17 of FIG. 16.
Figure 16:
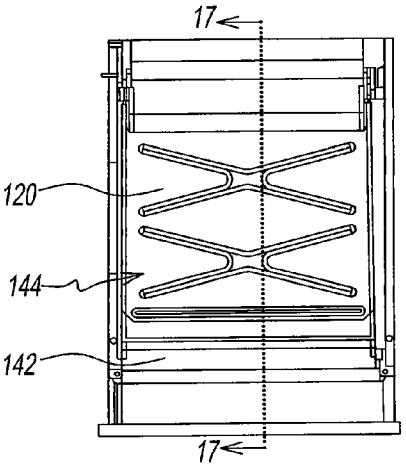
FIG. 16 is rear view of an ice making machine with a closed water curtain of the present disclosure.

FIG. 16 is a front view of water curtain 144, within machine 100, during a freeze cycle. FIG. 16 shows the improved two-piece or dual water curtain 144 comprised of articulated curtain-top portion 120 and articulated curtain bottom portion 142. FIG. 17 is a cross-sectional view as would be seen along line 17-17 of FIG. 16. More particularly, FIG. 17 shows that during an ice-forming cycle, water curtain top 120 hangs substantially vertically and spaced to the outside and substantially parallel to the surface of ice mold or evaporator 124. The bottom edge or bottom surface 143 of new curtain bottom 142 extends under ice mold or evaporator 124 preferably without touching the same.

Figure 19:
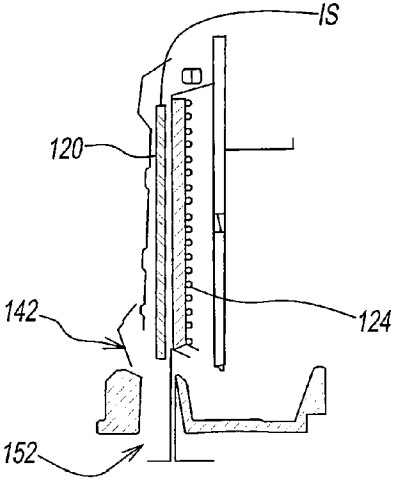
FIG. 19 is a cross-sectional view of the ice making machine of FIG. 18 along line 19-19 of FIG. 18.
Figure 18:
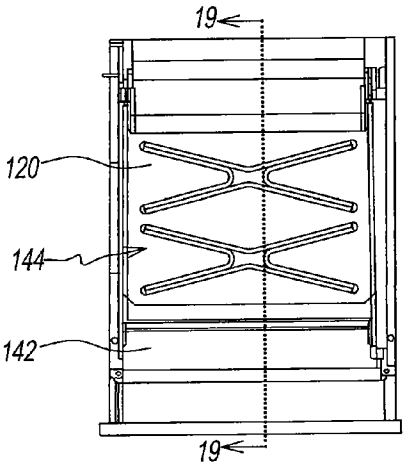
FIG. 18 is a rear view of an ice making machine with an open water curtain of the present disclosure.
Figure 20:
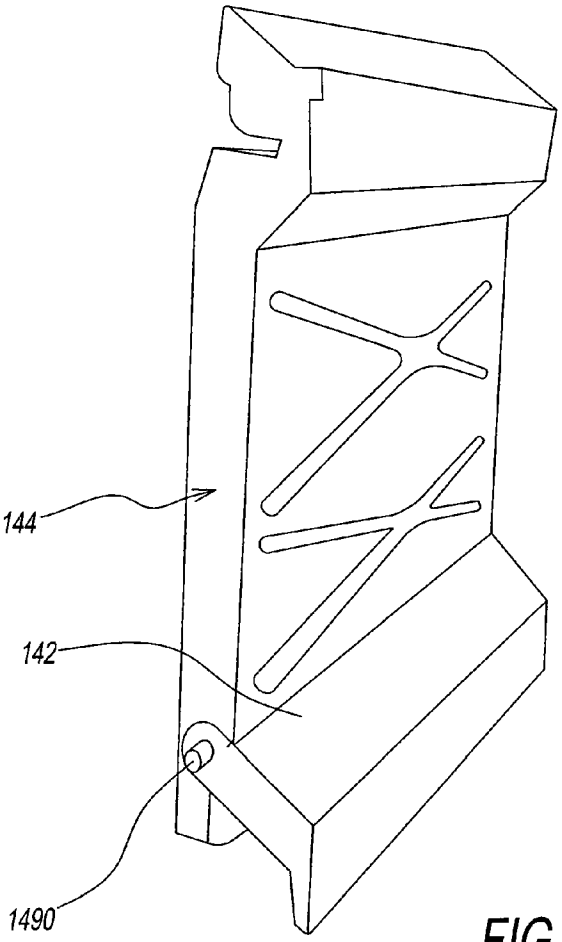
FIG. 20 is a rear view of an open water curtain of the present disclosure.

FIG. 18 is another front elevation of the new two-piece water curtain 144, within machine 100, during a harvest cycle. FIG. 19 shows that during harvesting, ice slab IS falls down between new curtain top 120 and mold or evaporator 124. The lower edge of ice slab IS engages or hits top surface 143 of new curtain bottom 142 and, against a weighted, gravity or other biasing force, that pivots curtain bottom 142 out of the way, such that with evaporator 24 positioned over and blocking ice chute 26, ice slab IS falls into bin 152. FIG. 20 shows curtain 144 in isolation during a harvest cycle, with bottom portion 142 pivoted rearward.

The following is a disclosure of the operation and controls of the improved ice-making machine 100 of the disclosure:

Once machine 100 is plugged in, it begins in an "OFF" mode on a controller. To start making ice, the "ON" button on the controller needs to be pressed. This begins the freeze cycle of the machine. The freeze cycle activates a compressor and a water pump to make evaporator 124 cold and to run water over the evaporator face to form a slab of ice. This process continues until an ice thickness sensor indicates to the controller that the ice slab is the proper thickness. This begins the start of the harvest cycle, which uses a hot gas to heat evaporator 124 and a harvest assist solenoid to aid in removing the slab from the evaporator face.

In the ice making machines of the disclosure, there are three operational modes that can occur once the slab of ice releases from the evaporator. The three modes are:

OP mode 1 (Actual Bin/Dispenser empty): the ice slab releases from evaporator 124 and falls and hits the bottom edge (hereinafter understood to include "a portion of bottom surface 143") of the bottom curtain. The bottom edge of the curtain gets knocked open. That is, the bottom edge or surface of the curtain 142 pivots at pivot points 1490 on impact, and the ice slab continues to fall through the machine into a bin or dispenser. (See FIGS. 3 and 4). The controller senses that the bottom edge of the curtain is open with an electro magnetic sensor, for example, that uses a magnet, or other suitable sensor. The bottom edge of the curtain 142 is biased to close or otherwise closes after the ice slab falls past it. The controller senses that the bottom edge of curtain 142 has closed and that it is ready to go into the freeze cycle again.

OP mode 2 (Actual Bin/Dispenser Full): The ice slab releases from evaporator 124 and falls. The ice slab hits the bottom edge of curtain 142, causing the bottom edge to be pivotably knocked open and the slab to begin to fall into the bin. If the bin is full, the ice slab would be prevented from completely passing the curtain. The ice slab keeps the curtain open, sending the machine into a "Bin Full" state. It puts the machine on hold preventing it from going into the freeze cycle until the ice is moved or melts, allowing the curtain to close.

OP mode 3 (False Bin/Dispenser Full): The ice slab releases from the evaporator and falls to hit the bottom edge of the curtain 142. The ice slab IS breaks into more then one piece due to the impact on the curtain bottom edge. The pieces continue to fall but there are occasions when some of the pieces will get stuck between the curtain, sump wall and evaporator. They never fully clear the bottom edge of the curtain 142 even though there is nothing to prevent the falling slab like with an empty bin or dispenser. The curtain stays open from the ice slab pieces that did not fully clear the curtain with a less than full bin/dispenser. This is called a "false" Bin Full. The machine will not run until the ice pieces melt and the curtain closes. The new smaller lightweight pivotable curtain bottom on the articulated curtain helps to reduce or prevent this problem.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. An ice-making machine, comprising:

an evaporator aligned in a generally vertical orientation, said evaporator comprising an ice-forming surface;

a distributor at a top end of said evaporator, said distributor for distributing water over said ice-forming surface; and a two-piece water curtain aligned in a generally vertical orientation, and located adjacent to and parallel to said evaporator, said two-piece water curtain comprising a first portion and a second portion, each being made of a single piece, solid structure to prevent water from passing through said solid structure of each of said first portion and said second portion, wherein said second portion is pivotally connected to said first portion, each of said first portion and said second portion having a top end and a bottom end;

wherein said top end of said first portion is pivotally connected to a top end of the ice-making machine, and said top end of said second portion is pivotally connected to said bottom end of said first portion.

2. The ice-making machine of claim 1, wherein said second portion pivots in a direction away from said evaporator.

3. The ice-making machine of claim 1, wherein said second portion of said two-piece water curtain is smaller than said first portion.

4. The ice-making machine of claim 1, wherein said bottom end of said first portion overlaps with said top end of said second portion.

5. The ice-making machine of claim 1, further comprising:

a sump at a bottom of the machine; and an ice-collecting bin adjacent to said sump, wherein during a freeze cycle, said second portion of said two-piece water curtain allows water into said sump, and during a harvest cycle said second portion directs ice formed on said ice-forming surface to fall into said ice-collecting bin.

6. The ice-making machine of claim 5, wherein during said freeze cycle, said bottom end of said second portion extends underneath a bottom end of said evaporator.

7. The ice-making machine of claim 1, wherein said second portion is connected to said first portion via pivot pins on said first portion.

* * * * *